US008145082B2

(12) United States Patent
Shigezaki et al.

(10) Patent No.: US 8,145,082 B2
(45) Date of Patent: Mar. 27, 2012

(54) IMAGE FORMING APPARATUS AND METHOD OF CONTROLLING TONER SUPPLY

(75) Inventors: Satoshi Shigezaki, Ebina (JP); Junichi Ichikawa, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 376 days.

(21) Appl. No.: 12/237,861

(22) Filed: Sep. 25, 2008

(65) Prior Publication Data

US 2009/0238589 A1 Sep. 24, 2009

(30) Foreign Application Priority Data

Mar. 18, 1920 (JP) ..... 2008-070452

(51) Int. Cl.
*G03G 15/00* (2006.01)

(52) U.S. Cl. ..... 399/49; 399/107; 399/159

(58) Field of Classification Search ..... 399/49
See application file for complete search history.

(56) References Cited

U.S. PATENT DOCUMENTS

| | | | | |
|---|---|---|---|---|
| 5,666,604 | A * | 9/1997 | Nakagami et al. | 399/171 |
| 5,693,443 | A | 12/1997 | Nakamura et al. | 430/66 |
| 6,029,021 | A | 2/2000 | Nishimura et al. | |
| 6,173,134 | B1 | 1/2001 | Nishimura et al. | |
| 2003/0129512 | A1 * | 7/2003 | Sugino et al. | 430/66 |
| 2004/0223776 | A1 * | 11/2004 | Ishida | 399/49 |

FOREIGN PATENT DOCUMENTS

| | | |
|---|---|---|
| JP | 9-204059 | 8/1997 |
| JP | 10-161365 A | 6/1998 |
| JP | 10-232523 | 9/1998 |
| JP | 2000-259059 | 9/2000 |
| JP | 2002-196546 A | 7/2002 |
| JP | 2003-005408 | 1/2003 |
| JP | 2006-267733 A | 10/2006 |

* cited by examiner

*Primary Examiner* — David Gray
*Assistant Examiner* — David Bolduc
(74) *Attorney, Agent, or Firm* — Morgan, Lewis & Bockius LLP

(57) ABSTRACT

The image forming apparatus includes: a photoconductor including a photoconductive layer and an overcoat layer containing electroconductive particles; a charging unit charging the photoconductor to first potential; an exposure unit setting an exposure region to have second potential smaller than the first potential in absolute values; a development unit including a developer carrier and a power supply setting the developer carrier to have third potential; a potential setting unit setting the third potential smaller than the first potential and larger than the second potential in a first image forming operation, and setting it larger than the first potential in a second image forming operation, in absolute values; a current setting unit setting an inflowing current to a fixed current value in the second image forming operation; a detection unit detecting image density in the second image forming operation; and a controller controlling toner supply according to the image density.

4 Claims, 8 Drawing Sheets

FIG.8

| ELECTROCONDUCTIVE PARTICLES / RESIN MATERIAL | TIN OXIDE | ZINC OXIDE | TITANIUM OXIDE |
|---|---|---|---|
| PHENOL RESIN | C | D | D |
| MELAMINE RESIN | B | C | C |
| BENZOGUANAMINE RESIN | A | C | C |

IMAGE FORMING APPARATUS AND METHOD OF CONTROLLING TONER SUPPLY

CROSS REFERENCE TO RELATED APPLICATIONS

This application is based on and claims priority under 35 USC §119 from Japanese Patent Application No. 2008-070452 filed Mar. 18, 2008.

BACKGROUND

1. Technical Field

The present invention relates to an image forming apparatus including a photoconductor, and a method of controlling toner supply.

2. Related Art

In image forming apparatuses such as electrophotographic copy machines and the like, an image is obtained by charging a photoconductor having a photoconductive layer, selectively exposing the charged photoconductor to form an electrostatic latent image on the photoconductor and developing the electrostatic latent image with toner charged with a predetermined polarity. In an image forming apparatus using a two-component developer including toner and carriers at the time of the development, included in the above type of the image forming apparatuses, density of the toner in the two-component developer affects density of an image.

SUMMARY

According to an aspect of the invention, there is provided an image forming apparatus including: a photoconductor that includes a photoconductive layer, and an overcoat layer containing electroconductive particles and provided on the photoconductive layer; a charging unit that charges the photoconductor to first potential; an exposure unit that sets an exposure region of the photoconductor to have second potential by exposing the photoconductor charged to the first potential by the charging unit, the second potential being smaller than the first potential in absolute values; a development unit that includes a developer carrier carrying a two-component developer containing toner and carriers and a developing power supply setting the developer carrier to have third potential different from the first potential and the second potential; a potential setting unit that sets the third potential smaller than the first potential and larger than the second potential in absolute values in a first image forming operation in which the photoconductor charged by the charging unit is exposed by the exposure unit and then developed by the development unit, and that sets the third potential larger than the first potential in absolute values in a second image forming operation in which the photoconductor charged by the charging unit is developed by the development unit without being exposed by the exposure unit; a current setting unit that sets an inflowing current caused to flow into the photoconductor from the charging unit, to a fixed current value set in advance, in the second image forming operation; a detection unit that detects image density of a toner image developed on the photoconductor in the second image forming operation; and a controller that controls toner supply with respect to the development unit in accordance with the image density detected by the detection unit.

BRIEF DESCRIPTION OF THE DRAWINGS

Exemplary embodiment (s) of the present invention will be described in detail based on the following figures, wherein:

FIG. 8 is a table showing the evaluation results.

DETAILED DESCRIPTION

Hereinafter, a detailed description will be given of an exemplary embodiment of the present invention with reference to attached drawings.

Figure 1:
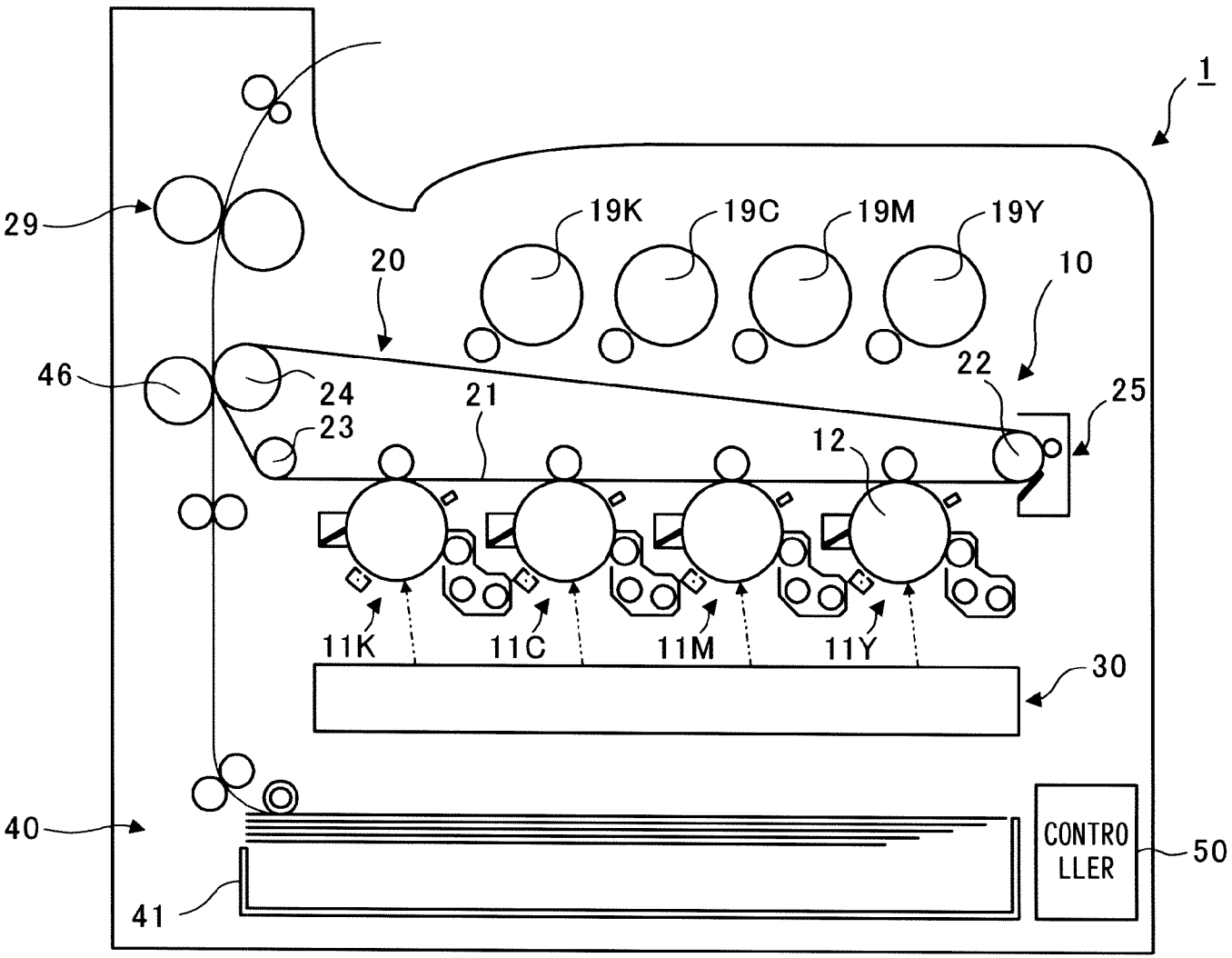
FIG. 1 is a diagram showing an entire configuration of a printer as an image forming apparatus to which the exemplary embodiment is applied.

FIG. 1 is a diagram showing an entire configuration of a printer 1 as an image forming apparatus to which the exemplary embodiment is applied. The printer 1 is provided with an image forming unit 10 that forms an image on a paper sheet in accordance with respective color toner data, a paper sheet transporting unit 40 that transports a paper sheet, a controller 50 that controls operation of the printer 1 including the image forming unit 10 and the paper sheet transporting unit 40.

The image forming unit 10 is provided with four image forming parts 11 for yellow (Y), magenta (M), cyan (C) and black (K) (specifically, 11Y, 11M, 11C and 11K) that are arranged in parallel at a certain interval in a horizontal direction, a transfer unit 20 that superimposingly transfers respective color toner images formed on photoconductor drums 12 of the image forming parts 11 onto an intermediate transfer belt 21, and an exposure unit 30 that irradiates respective image forming parts 11 with a laser. In addition, the printer 1 is provided with a fixing unit 29 that fixes toner images secondarily transferred on a paper sheet by the transfer unit 20.

On an upper side of the intermediate transfer belt 21, four toner cartridges 19 (19Y, 19M, 19C and 19K) that contain respective Y, M, C and K color toners are provided. Each of the toner cartridges 19 supplies corresponding color toner to a development device 14 (refer to FIG. 2) provided in the corresponding color image forming part 11.

The transfer unit 20 is provided with a driving roll 22 that drives the intermediate transfer belt 21, a tension roll 23 that applies certain tension to the intermediate transfer belt 21, a back-up roll 24 for supporting the intermediate transfer belt 21 at a secondary transfer portion where the superimposed color toner images are secondarily transferred onto a paper sheet, and a belt cleaner 25 that removes remaining toner and the like on the intermediate transfer belt 21. The intermediate transfer belt 21 is stretched between the driving roll 22, the tension roll 23 and the back-up roll 24, and is driven by the driving roll 22 to circularly move.

The exposure unit 30 as an example of an exposure unit is provided with a laser diode, a modulator, a polygon mirror, various kinds of lenses and mirrors and the like, which are not shown in the figure. The exposure unit 30 is configured so as to scans and exposes the respective photoconductor drums 12 of the image forming parts 11 with a laser.

The paper sheet transporting unit 40 is provided with a paper sheet stacking part 41 that stacks paper sheets, and a secondary transfer roll 46 that is provided at a secondary transfer position, and presses against the back-up roll 24 through a paper sheet to secondarily transfer an image on the paper sheet.

Figure 2:
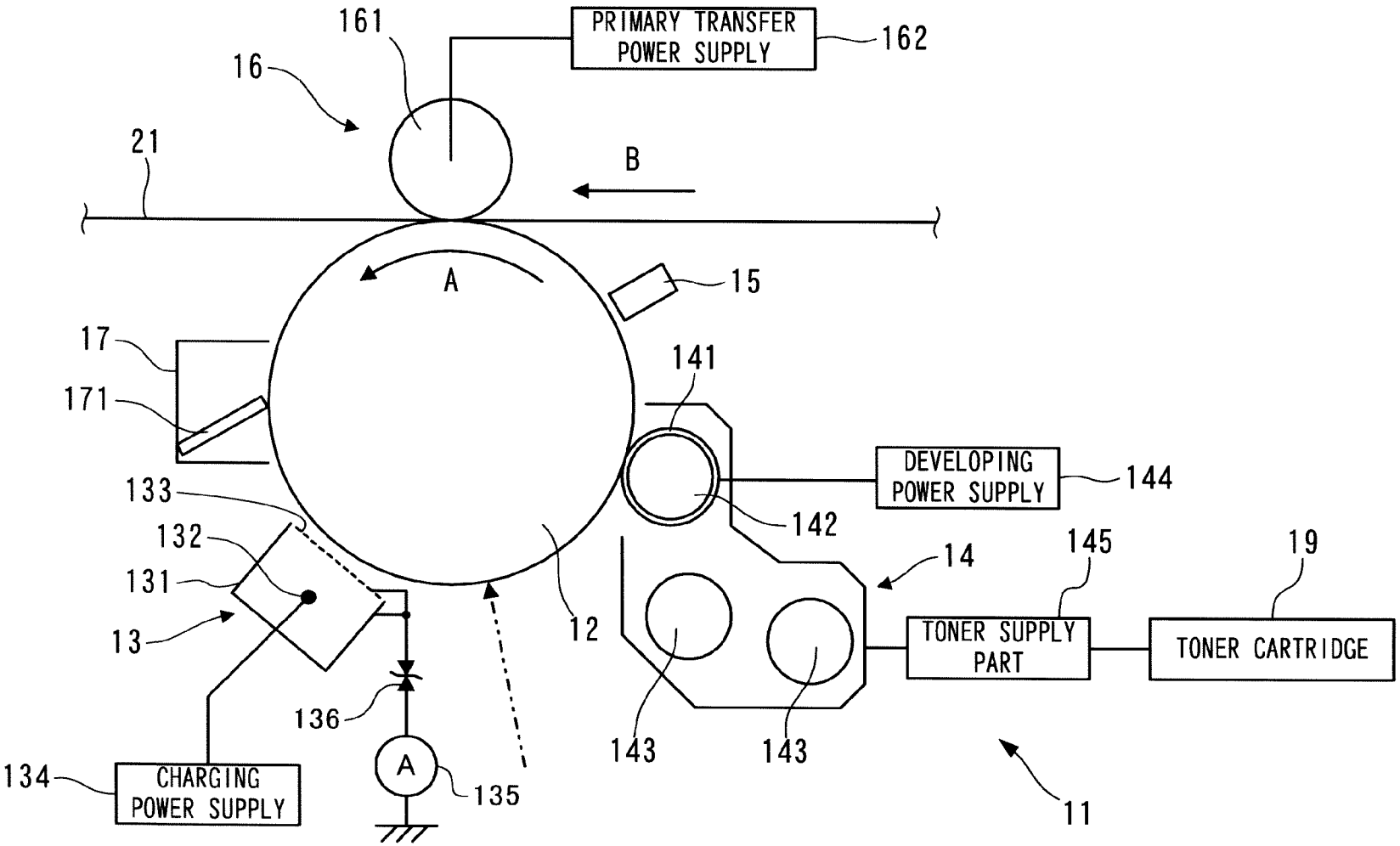
FIG. 2 is a diagram for explaining a configuration of each of the image forming parts.

FIG. 2 is a diagram for explaining a configuration of each of the image forming parts 11. It should be noted that respective image forming parts 11 have the same configuration except a color of the used toner. Each of the image forming parts 11 is provided with a photoconductor drum 12 that rotates in an arrow A direction. Further, around the photoconductor drum 12, a charging device 13, a development device 14, a density sensor 15, a primary transfer device 16 and a photoconductor cleaner 17 are sequentially arranged along the arrow A direction.

Among these, the charging device 13, as an example of a charging unit, is provided along an axial direction of the photoconductor drum 12, and is provided with a charge case 131 having a substantially squared-U cross-sectional shape and having an opening portion at a position opposed to the photoconductor drum 12, a discharge wire 132 extending inside the charge case 131 while being supported by supporting parts (not shown in the figure) respectively provided on both ends in a longitudinal direction of the charge case 131, and a grid electrode 133 disposed on a side closer to the opening portion of the charge case 131 so as to be opposed to the photoconductor drum 12. Here, the discharge wire 132 is connected to a charging power supply 134 for applying a direct-current charging bias with a negative polarity. It should be noted that a current supply that supplies a constant current is used as the charging power supply 134 in the present exemplary embodiment. In the meantime, the charge case 131 and the grid electrode 133 are grounded via an ammeter 135 and a constant-voltage element 136. The constant-voltage element 136 has a function of maintaining the charge case 131 and the grid electrode 133 at constant potential, and is formed of, for example, a varistor (non-linear resistance element) and the like. Meanwhile, the grid electrode 133 is formed of a mesh-like metal material on which many air holes are formed. Here, as the grid electrode 133, other than such a mesh-like material, a board material on which many slits are formed may be used, for example. In addition, although the charge case 131 and the grid electrode 133 are grounded via the constant-voltage element 136 in the present exemplary embodiment, instead of connecting them via the constant-voltage element 136, a power supply may be directly connected to them, for example.

The development device 14 as an example of a development unit is provided along an axial direction of the photoconductor drum 12, and is provided with a developing sleeve 141 as an developer carrier that is arranged so as to be opposed to the photoconductor drum 12, a magnet roll 142 that is covered by the developing sleeve 141, and a pair of supply members 143 that supplies two-component developer including toner and carriers to a developing roll formed of the developing sleeve 141 and the magnet roll 142. In the present exemplary embodiment, while the magnet roll 142 is fixed, the developing sleeve 141 rotates. Meanwhile, in the two-component developer, the toner has a negative charging polarity. The development device 14 is further provided with a developing power supply 144 that supplies a developing bias to the developing sleeve 141. Here, the developing power supply 144 supplies a direct-current developing bias with a negative polarity to the developing sleeve 141. It should be noted that the developing power supply 144 may be configured so as to apply a developing bias in which an alternate current is superimposed on a direct current to the developing sleeve 141. Further, the development device 14 is provided with a toner supply part 145 that supplies toner from the toner cartridge 19 to the development device 14.

The density sensor 15 as an example of a detection unit is arranged between the development device 14 and the primary transfer device 16 and is arranged so as to be opposed to the photoconductor drum 12, and the density sensor 15 detects density of a toner image developed on the photoconductor drum 12 by the development device 14. It should be noted that the density sensor 15 is composed of a light emitting element that irradiates the photoconductor drum 12 with light and a light receiving element that receives light reflected from the photoconductor drum 12 or a toner image on the photoconductor drum 12.

The primary transfer device 16 is provided with a primary transfer roll 161 that is arranged so as to be opposed to the photoconductor drum 12 through the intermediate transfer belt 21. The primary transfer roll 161 is rotated by receiving, at a position where the primary transfer roll 161 is opposed to the photoconductor drum 12, driving force of the intermediate transfer belt 21 that rotates in an arrow B direction same as an rotation direction A of the photoconductor drum 12. Further, to the primary transfer roll 161, a primary transfer power supply 162 is connected. Here, the primary transfer power supply 162 applies a primary transfer bias with a positive polarity to the primary transfer roll 161.

The photoconductor cleaner 17 is provided with a blade member 171 that is arranged so as to be in contact with the photoconductor drum 12.

It should be noted that the controller 50 shown in FIG. 1 functions as a potential setting unit, a current setting unit and a controller, and controls operation of the above described charging power supply 134, developing power supply 144, toner supply part 145 and the primary transfer power supply 162. In addition, the controller 50 also controls driving of the photoconductor drum 12 and the developing sleeve 141, driving of the intermediate transfer belt 21 through the driving roll 22 shown in FIG. 1, a paper sheet transportation in the paper sheet transporting unit 40, the secondary transfer bias applied to the secondary transfer portion, and a fixing operation in the fixing unit 29. Further, to the controller 50, a measurement result of a current by the ammeter 135 and a measurement result of density by the density sensor 15 are inputted.

Next, a detailed description will be given of a configuration of the photoconductor drum 12.

Figure 3:
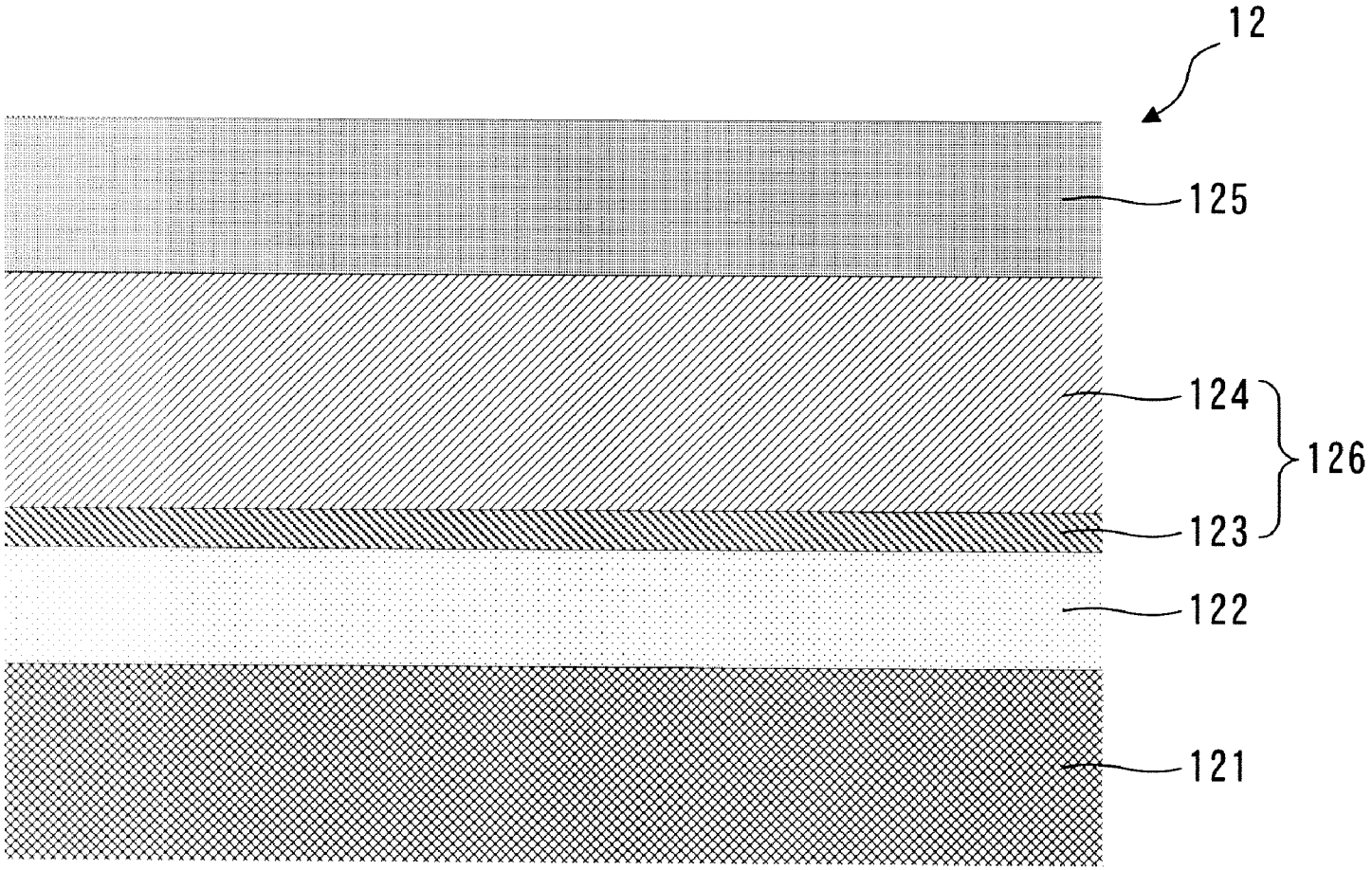
FIG. 3 is a view showing a cross-section of the photoconductor drum.

FIG. 3 is a view showing a cross-section of the photoconductor drum 12. The photoconductor drum 12 is provided with an electroconductive substrate 121, an undercoat layer 122 formed on the electroconductive substrate 121, a charge generation layer 123 formed on the undercoat layer 122, a charge transport layer 124 formed on the charge generation layer 123 and an overcoat layer 125 formed on the charge transport layer 124. It should be noted that, in this example, a photoconductive layer 126 is formed of the charge generation layer 123 and the charge transport layer 124.

Among them, the electroconductive substrate 121 is not particularly limited as long as it is a material having electric conductivity, and, for example, there is used a metal material such as an aluminum alloy and the like. It should be noted that the electroconductive substrate 121 is grounded when the photoconductor drum 12 is attached to the printer 1. In addition, the electroconductive substrate 121 is not limited to be in a drum shape, and it may be in a belt shape or a sheet shape, for example.

The undercoat layer 122 functions as an adhesive layer which prevents the injection of a charge from the electroconductive substrate 121 to the photoconductive layer 126 and integrally holds the photoconductive layer 126 to the electroconductive substrate 121 when the photoconductive layer 126 which has a laminated structure is charged. Such an undercoat layer 122 is made of, for example, a material containing metal oxide particles and a binding resin.

The charge generation layer 123 generates a carrier pair which is an electron and a hole, according to light irradiation. The charge generation layer 123 is formed by containing a charge generation material and a binding resin.

The charge transport layer 124 transports a carrier generated by the charge generation layer 123 according to the light irradiation. The charge transport layer 124 is formed, for example, by applying and drying a coating agent in which a charge transport material and a binding resin are dissolved and/or dispersed in a predetermined solvent. It should be noted that, in the present exemplary embodiment, the charge transport layer 124 has a function for transporting a hole as a carrier.

The overcoat layer 125 is provided in order to improve wear resistance of the outer circumferential surface (hereinafter, simply referred to as the surface) of the photoconductor drum 12 and to suppress chemical changes of the charge generation layer 123 and the charge transport layer 124 at the charge of the photoconductor drum 12. Here, the overcoat layer 125 is formed of electroconductive particles and a resin containing at least one kind of charge-transporting compound. As for this resin forming the overcoat layer 125, it is preferable to use one having a cross-linked structure in order to improve wear resistance and secure sufficient hardness. If such a resin is not used, the surface hardness would be low and sufficient wear resistance would be difficult to obtain; thus, scratches and progress of wear tend to occur. Therefore, in the case where a rate of image formation should be increased or where image formation is performed for an extremely long period of time, if a resin having a cross-linked structure is not used, a high-quality image would be difficult to obtain. It should be noted that, as a resin forming the overcoat layer 125, other than a resin having a cross-linked structure, lubricating particles, without cross-linked structure, made of a binder resin, a fluorocarbon resin, an acryl resin and the like may be included if necessary. Here, for forming of the overcoat layer 125, a hard-coat agent, such as silicone or acryl, may be used if necessary. A method of forming the overcoat layer 125 will be described in detail below. For the forming of the overcoat layer 125, used is a solution for forming an outermost-surface-layer, containing at least a precursor forming a resin having a cross-linked structure. Here, as a resin having a cross-linked structure, various materials may be used in terms of securing hardness of the overcoat layer 125. As such resins, a phenol resin, a melamine resin, a benzoguanamine resin, a siloxane resin, a urethane resin, an epoxy resin and the like may be cited. Among these, a phenol resin, a melamine resin, and a benzoguanamine resin are preferable in terms of durability, and a benzoguanamine resin is most preferred among these. Furthermore, from the perspective of electric characteristics and image maintaining characteristics, a resin having a cross-linked structure preferably has charge transporting characteristics (includes a structural unit having charge transporting ability). In such a case, the overcoat layer 125 may function as a part of the charge transport layer 124. As for a structural unit having the charge transporting ability, it is preferably a charge transporting material including at least one kind selected from a hydroxyl group, a carboxyl group, an alkoxysilyl group, an epoxy group, a thiol group, and an amino group.

Now, a configuration example of the photoconductor drum 12 will be described below.

Configuration Example

To 170 weight parts of n-butyl alcohol in which 4 weight parts of a polyvinyl butyral resin (S-LEC BM-S, manufactured by Sekisui Chemical Co., Ltd.) is dissolved, 30 weight parts of an organic zirconium compound (acetyl acetone zirconium butylate) and 3 weight parts of an organic silane compound (γ-aminopropyltrimethoxysilane) are added and stirred to prepare a coating liquid for forming an undercoat layer. This coating liquid is applied on an aluminum support by dipping. Here, the aluminum support is the electroconductive substrate 121, and has an outer diameter of 84 mm and a surface roughened by the honing treatment. Subsequently, after dried by air at room temperature for 5 minutes, temperature of the electroconductive substrate 121 is raised to 50° C. in 10 minutes, placed in a thermohygrostat maintained at 50° C. and 85% RH (dew point 47° C.), and subjected to a humidification treatment for curing promotion for 20 minutes. Thereafter, the electroconductive substrate 121 is placed in a hot-air drier and dried at 160° C. for 15 minutes to form the undercoat layer 122 on the electroconductive substrate 121.

A mixture of 15 weight parts of chlorogallium phthalocyanine functioning as a charge generating material, 10 weight parts of a vinyl chloride-vinyl acetate copolymer resin (VMCH, manufactured by Nippon Unicar Co., Ltd.), and 300 weight parts of n-butyl alcohol is dispersed for 4 hours using a sand mill. The obtained dispersion liquid is applied on the undercoat layer 122 by dipping and dried to form the charge generation layer 123 having a film thickness of 0.25 μm.

Next, 40 weight parts of N,N'-bis(3-methylphenyl)-N,N'-diphenylbenzidine functioning as a charge transporting material and 60 weight parts of a bisphenol Z polycarbonate resin (molecular weight 40,000) are sufficiently dissolved and mixed into 230 weight parts of tetrahydrofuran and 100 weight parts of monochlorobenzene to obtain a coating liquid. The coating liquid is applied on the charge generation layer 123 by dipping, and dried at 115° C. for 40 minutes to form the charge transport layer 124 having a film thickness of 22 μm.

Six weight parts of a compound 1 expressed by the structural formula below and 7 weight parts of a benzoguanamine resin (NIKALAC BL-60: Sanwa Chemical Co., Ltd.) are dissolved into 10 weight parts of isopropyl alcohol, and, after a predetermined amount of electroconductive particles are added thereto, dispersed for 5 hours with 10 weight parts of glass beads (ϕ 1.0 mm) by use of a paint shaker. Thereafter, the glass beads are isolated by filtration, and then a coating liquid for forming an overcoat layer is obtained. This coating liquid for forming an overcoat layer is applied on the charge transport layer 124 by dipping, dried by air at room temperature for 20 minutes and dried at 150° C. for 35 minutes to form the overcoat layer 125 having a film thickness of 4 μm. By the above-described process, the photoconductor drum 12 is obtained.

COMPOUND 1

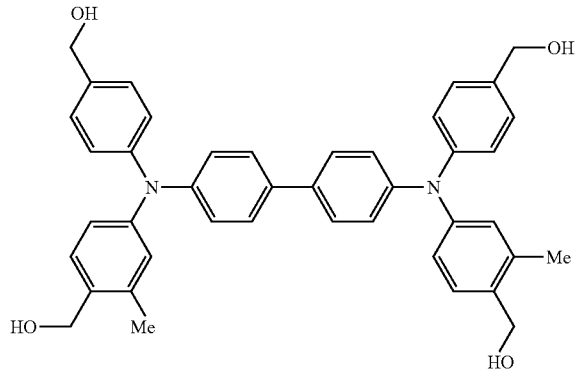

It should be noted that, as for the electroconductive particles forming the overcoat layer 125, any material may be appropriately selected from various materials as long as it has a predetermined electroconductivity. However, it is preferable to use particles of metal or metal oxide. Here, as metal, aluminum, zinc, copper, chrome, nickel, silver, and stainless steel, and materials made of plastic particles having these metals deposited on the surface are cited, for example. Meanwhile, as metal oxide, zinc oxide, titanium oxide, tin oxide, antimony oxide, indium oxide, bismuth oxide, indium oxide doped with tin, tin oxide doped with antimony or tantalum, and zirconium oxide doped with antimony are cited, for example. These metals or metal oxides may be used alone or in combination of two or more kinds. In the case of using them in combination of two or more kinds, they may be simply mixed, transformed into solid solution or fusion bonded. It should be noted that, in the present exemplary embodiment, among these various materials, especially among various metal oxides, it is preferable to use tin oxide from the perspective of transparency and dispersivity. Meanwhile, in terms of securing transparency of the overcoat layer 125, the average particle diameter of the electroconductive particles is preferably 0.3 μm or smaller, especially 0.1 μm or smaller. Here, the average particle diameter of the electroconductive particles in the present exemplary embodiment is a particle diameter (referred to as a volume-average particle diameter d50) when the cumulative volume distribution of the electroconductive particles reaches 50%. Then, the volume-average particle diameter d50 of the electroconductive particles is measurable by use of a laser diffraction and diffusion particle-size distribution measuring apparatus "Mastersizer 2000" (product name) manufactured by Malvern Instruments Ltd., for example. Meanwhile, the amount of the electroconductive particles added to a solid component made of a charge transporting compound, resin or the like forming the overcoat layer 125 may be selected accordingly. However, from the perspective of reducing fluctuations of charge characteristics of the surface of the photoconductor drum 12 due to wear of the overcoat layer 125, which will be described later, a preferable amount is 0.1 by weight of the overcoat layer 125 or above. From the perspective of securing transparency of the overcoat layer 125 and securing dispersivity of the electroconductive particles in the overcoat layer 125, a preferable amount is 5.0% by weight of the overcoat layer 125 or less.

Next, a description will be given for the image forming operation by the printer 1. Image data that is inputted from an outside and is subjected to the image processing in the image processor are converted into color material gradation data of four colors which are yellow (Y), magenta (M), cyan (C) and black (K), and the resultant data are outputted to the exposure unit 30.

In the exposure unit 30, with a laser light for each color outputted from a laser diode, respective photoconductor drum 12 of the image forming parts 11 are irradiated via an optical system (not shown in the figure), in accordance with the inputted color material gradation data. In each of the rotating photoconductor drums 12, the surface charged by the charging device 13 is scanned and exposed, and a certain electrostatic latent image is formed. The electrostatic latent image formed on the photoconductor drum 12 is developed as a toner image of each color of yellow (Y), magenta (M), cyan (C) and black (K) in the development device 14 of each of the image forming parts 11.

The toner images formed on the photoconductor drums 12 of the image forming parts 11 are sequentially transferred on the intermediate transfer belt 21 by the primary transfer device 16 provided to the corresponding image forming parts 11. In addition, on the photoconductor drum 12 after the primary transfer, remaining toner and the like are removed by the photoconductor cleaner 17 to be ready for the next charging.

On the other hand, in the paper sheet transporting unit 40, a paper sheet taken out from the paper sheet stacking part 41 is supplied to the secondary transfer position at a predetermined timing. Then, the toner images that have been superimposingly transferred onto the intermediate transfer belt 21 are secondarily transferred onto the paper sheet in sequence in the sub-scanning direction. Thereafter, the paper sheet on which the toner images have been secondarily transferred is subjected to a fixing processing by the fixing unit 29, and then is outputted. It should be noted that, after the secondary transfer, remaining toner on the intermediate transfer belt 21 is removed by the belt cleaner 25 to be ready for the primary transfer.

Figure 4:
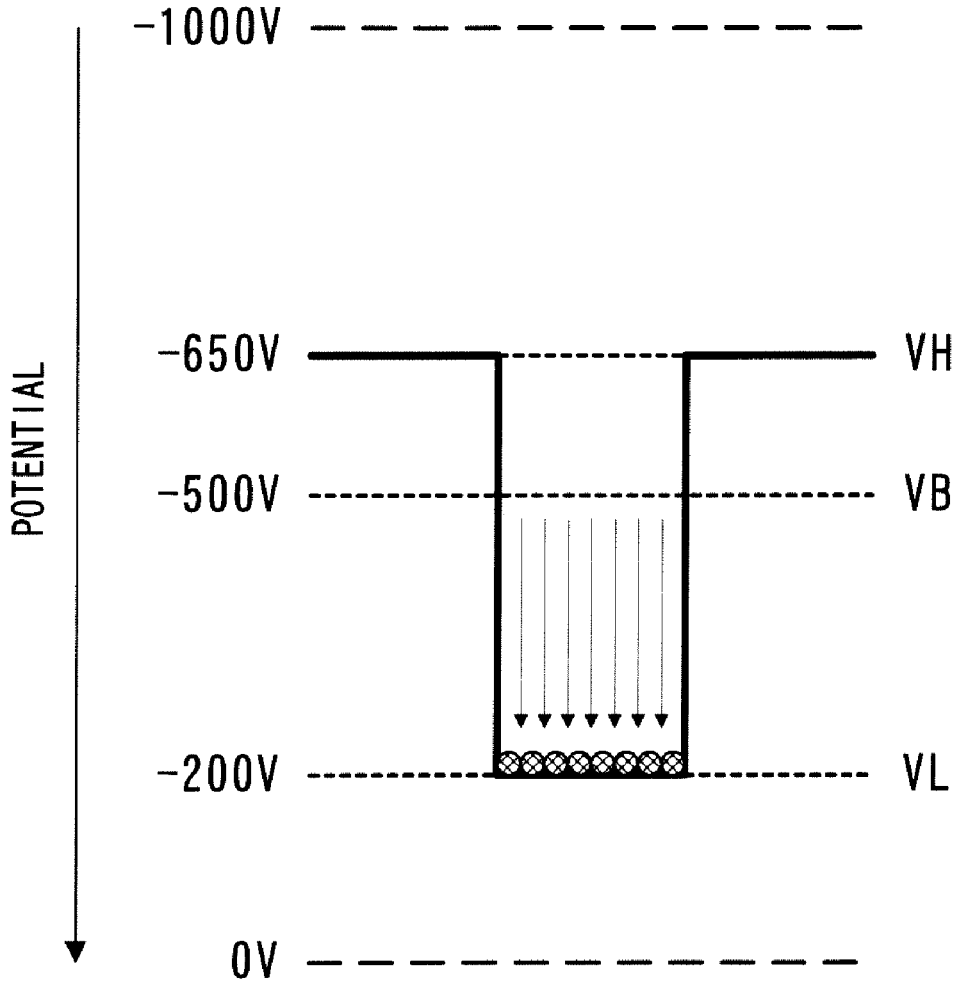
FIG. 4 shows an example of a potential level on the photoconductor drum in an image forming operation (first image forming operation)

FIG. 4 shows an example of a potential level on the photoconductor drum 12 in an image forming operation (first image forming operation).

In the photoconductor drum 12 to which a negative current, that is, negative charge is supplied by the charging device 13, negative charge is held on the surface of the overcoat layer 125. As a result, the photoconductor drum 12 is charged to have charge potential VH (first potential) of −650 V. At this time, the controller 50 controls the charging power supply 134 to supply a current to the discharge wire 132 so that the charge potential VH on the surface of the photoconductor drum 12 is −650 V. In the present exemplary embodiment, a so-called scorotron charger is used as the charging device 13. Accordingly, part of the current supplied to the discharge wire 132 from the charging power supply 134 goes through the grid electrode 133 and flows into the photoconductor drum 12, and the rest flows into the ammeter 135 through the charge case 131 and the grid electrode 133. It should be noted that, in the following descriptions, a current supplied from the charging power supply 134 to the discharge wire 132 is referred to as a supply current, a current flowing into the photoconductor drum 12 from the discharge wire 132 is referred to as an inflowing current, and a current flowing into the charge case 131 and the grid electrode 133 from the discharge wire 132 is referred to as an outflowing current. Here, the relationships among the supply current, the inflowing current, and the outflowing current have been examined in advance. According to the measurement result of the outflowing current by the ammeter 135, the controller 50 controls a supply current from the charging power supply 134 to the discharge wire 132 so as to allow an inflowing current achieving the charge potential VH of the photoconductor drum 12 of −650V to flow.

Then, the photoconductor drum 12 charged at −650V is selectively irradiated with a laser beam from the exposure unit 30. In a part irradiated with a laser beam in the photoconductor drum 12, that is, in an exposed region, charge pairs each including positive and negative charges are generated in the charge generation layer 123. Then, the generated positive charges migrate from the charge generation layer 123 to the overcoat layer 125 via the charge transport layer 124 due to the effect of the electric field, bind to negative charges on the overcoat layer 125, respectively, and disappear. On the other hand, the generated negative charges migrate from the charge generation layer 123 to the electroconductive substrate 121 via the undercoat layer 122 due to the effect of the electric field. As a result, the potential of an image region irradiated with the laser beam in the photoconductor drum 12, that is, exposure potential VL (second potential) is decreased to approximately −200 V, while the potential of a background region irradiated with no laser beam is maintained to remain the charge potential VH of approximately −650 V. As described above, an electrostatic latent image composed of the image region and the background region is formed on the surface of the photoconductor drum 12.

In the development device 14, the developing power supply 144 supplies a predetermined developing bias to the developing sleeve 141, and sets developing potential VB (third potential) to −500 V. At this time, in absolute values, the developing potential VB, which is the third potential, is smaller than the charge potential VH, which is the first potential, and larger than the exposure potential VL, which is the second potential. Accordingly, the image region (exposure potential VL: −200 V) on the surface of the photoconductor drum 12 is relatively positive (+300 V) with respect to the developing sleeve 141. On the other hand, the background region (charge potential VH: −650 V) on the surface of the photoconductor drum 12 is relatively negative (−150 V) with respect to the developing sleeve 141. Therefore, toner charged to negative polarity and held on the developing sleeve 141 is transferred to the image region but is unlikely to be transferred to the background region. For this reason, a toner image corresponding to the image region (exposed region) is developed on the photoconductor drum 12. As described above, image formation is performed by use of a so-called reversal development method in the present exemplary embodiment.

It should be noted that, since the primary transfer power supply 162 applies a primary transfer bias having positive polarity to the primary transfer roll 161, toner on the photoconductor drum 12 is to be primarily transferred onto the intermediate transfer belt 21.

By the way, the printer 1 of the present exemplary embodiment uses a two-component developer containing toner and carriers in the development device 14. Since toner is consumed as an image forming operation proceeds, the toner density in the two-component developer decreases. Accordingly, in the printer 1, the controller 50 instructs to perform an operation to detect the toner density in the two-component developer at a predetermined timing, and to perform an operation to supply toner from the toner cartridge 19 to the development device 14 as necessary.

Figure 5:
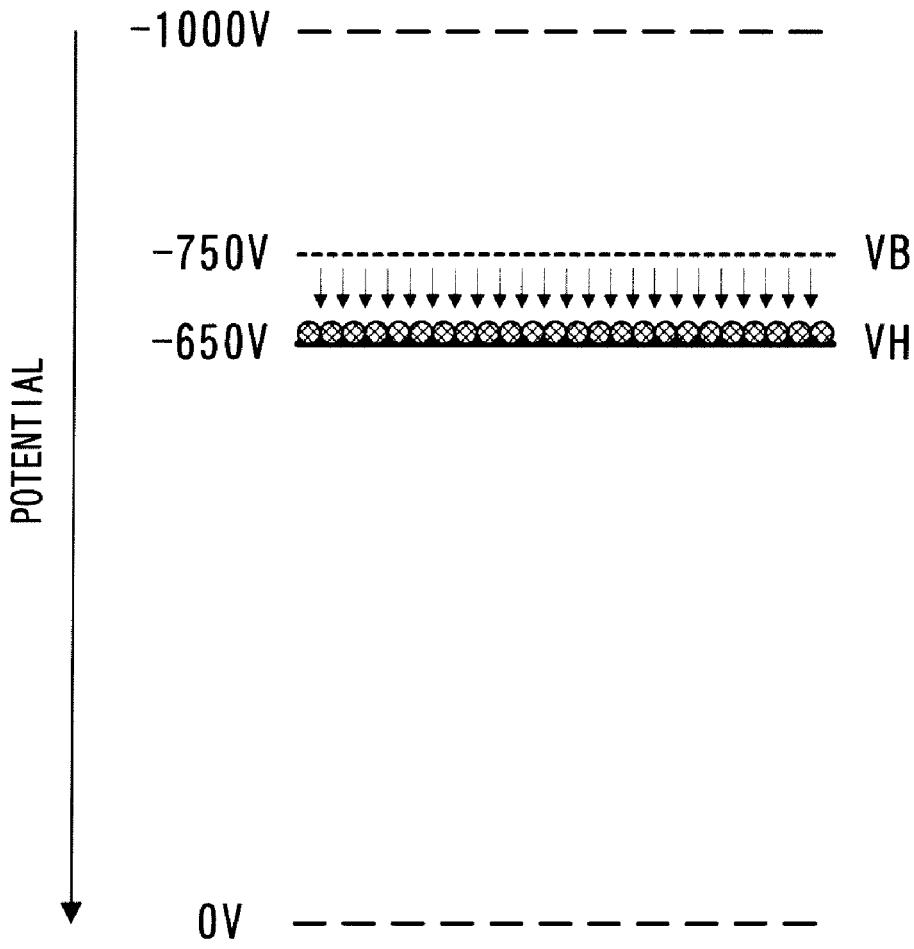
FIG. 5 shows an example of a potential level on the photoconductor drum in an operation of detecting toner density (second image forming operation)

Now, a description will be given of an operation of detecting toner density and operation of determining an amount of toner to be supplied. It should be noted that these operations are performed during a non-image forming period when an image forming operation is not performed, for example, when the printer 1 is turned on or when an image forming operation of a predetermined number of images in the printer 1 is completed. Here, FIG. 5 shows an example of a potential level on the photoconductor drum 12 in an operation of detecting toner density (second image forming operation).

With the initiation of the operation, the controller 50 adjusts a supply current from the charging power supply 134 of the charging device 13 so that an inflowing current flowing into the photoconductor drum 12 has a predetermined fixed current value. The controller 50 also rotates the photoconductor drum 12 at the same circumferential velocity as that in the image forming operation. As a result, the photoconductor drum 12 is charged to have the same charge potential VH (−650 V: first potential) as that in the image forming operation.

After adjusting the inflowing current to the photoconductor drum 12 to a set value as described above, the controller 50 achieves a state in which no irradiation (exposure) of a laser beam from the exposure unit 30 is allowed. By this operation, the charge potential VH (−650 V) of the photoconductor drum 12 is maintained even after the photoconductor drum 12 has passed the exposure position.

In addition, the controller 50 causes the developing power supply 144 to supply, to the developing sleeve 141, a developing bias different from that in the image forming operation, and sets developing potential VB (third potential) to −750 V. At this time, in absolute values, the developing potential VB, which is the third potential, is larger than the charge potential VH, which is the first potential. Accordingly, the photoconductor drum 12 (charge potential VH: −650 V) is relatively positive (+100 V) with respect to the developing sleeve 141. In other words, the charge potential VH and the developing potential VB have the reverse relationship to that in the image forming operation. Therefore, toner held in the developing sleeve 141 uniformly transfers to the photoconductor drum 12. Here, at this time, the photoconductor drum 12 is in a state being charged but not exposed, and the entire region thereof is a charged region. It should be noted that, the developing potential VB is set to −750 V only for a predetermined period of time. Accordingly, a strip-shaped toner image extending along a main scanning direction (a patch for toner density detection) is developed on the photoconductor drum 12. To be more specific, unlike in the toner image forming operation, toner is transferred and attached to the background region (charged region) in the operation of detecting the toner density.

The strip-shaped patch for toner density detection formed on the photoconductor drum 12 passes a portion that is opposed to the density sensor 15 along with the rotation of the photoconductor drum 12. In the density sensor 15, an amount of reflected light Vpatch, from the patch for toner density detection formed on the photoconductor drum 12 and an amount of reflected light Vclean, from a portion where no toner is placed are detected, and the detected signals are respectively amplified and outputted to the controller 50.

Next, a reflectance R=Vpatch/Vclean is calculated in the controller 50. Here, the reflectance R reflects toner density in the two-component developer. Accordingly, the reflectance R is small when the toner density is high, while the reflectance R is large when the toner density is low. Then, the controller 50 performs a comparison operation between the obtained reflectance R and a predetermined target value, and determines whether or not to supply toner to the development device 14 on the basis of the difference between the reflectance R and the target value, and, in the case of supplying toner to the development device 14, determines how much toner should be supplied. Here, an amount of toner to be supplied is determined in accordance with the reflectance R, and is large when the reflectance R is significantly large.

Then, in the case of having determined to supply toner, the toner supply part 145 supplies a determined amount of toner to be supplied to the development device 14 from the toner cartridge 19. These operations of detecting toner density and of determining an amount of toner to be supplied are performed in the respective image forming parts 11.

It should be noted that, in operations of detecting toner density, although the charge potential VH of the photoconductor drum 12 is set to be the same as that in the image forming operation (−650 V) and the developing potential VB is set to −750 V which is different from that in the image forming operation (−500 V) in the present example, the present invention is not limited to this. For example, in the case where the charge potential VH of the photoconductor drum 12 is set to −300 V, which is different from that in the image forming operation (−650 V), and the developing potential VB is set to the same as that in the image forming operation (−500 V) in the operation of detecting toner density, toner is also transferred and attached to the background region having charge potential VH, and a toner image is to be formed.

Alternatively, by setting two or more kinds of charge potential VH (for example, the above-mentioned −650 V and −300 V) and by transferring toner to individual regions having different charge potential VH, control on toner supply may be performed on the basis of measurement results of respective image density.

Furthermore, although an amount of toner to be supplied to the development device 14 is determined on the basis of a detection result of toner density in the present example, the present invention is not limited to this. For example, for short-term density adjustment, on the basis of a detection result of toner density, an inflowing current flowing into the photoconductor drum 12 from the charging device 13 and the intensity of a laser beam from the exposure unit 30 may also be adjusted.

As described above, in the present exemplary embodiment, a toner image is formed on a portion which serves as a background region in a regular image forming operation by setting the developing potential VB higher than the charge potential VH in absolute values, and toner density in a two-component developer is estimated by measuring the image density of the toner image. This is because the charge potential VH is more stable than the exposure potential VL which is susceptible to the effect of fluctuations in photosensitivity due to environmental change and the like.

It should be noted that, being scratched by the intermediate transfer belt 21 and the blade member 171, the surface of the photoconductor drum 12 gradually wears out after a long-term use. In addition, the degree of wear on the surface of the photoconductor drum 12 is not necessarily uniform, and portions worn out more and portions worn out less may locally occur. Then, changes in the charge characteristics of the photoconductor drum 12 occur due to wear on the surface of the photoconductor drum 12; thus, there is a risk that the charge potential VH fluctuates.

In dealing with this, in the present exemplary embodiment, electroconductive particles are added in advance to the overcoat layer 125 which is the uppermost layer of the photoconductor drum 12 so as to reduce such fluctuations of the charge characteristics.

Then, an experiment conducted by the present inventors will be described.

The inventors prepare a photoconductor drum 12 in which tin oxide ($SnO_2$) having 1% by weight of the overcoat layer 125, as a kind of electroconductive particle, is added to the overcoat layer 125 located on the surface of the photoconductor drum 12 and a photoconductor drum 12 to which no tin oxide is added, and evaluate the relationship between the amount of charge provided to each of the photoconductor drums 12 and the amount of the potential generated on the surface of each of the photoconductor drums 12. Here, in the present experiment, in order to investigate the relationship with wear on the overcoat layer 125, photoconductor drums 12 having a overcoat layer 125 with a thickness of 6 μm, 7 μm, and 8 μm, respectively, are prepared respectively for one having addition of tin oxide and one having no addition of tin oxide. It should be noted that, the amount of charge provided to the photoconductor drum 12 is proportional to an inflowing current flowing into the photoconductor drum 12. This is because a current is expressed as an amount of charge flowing through a certain cross section per unit time (i=dQ/dt).

Hereinafter, the evaluation method will be described.

The respective photoconductor drums 12 are rotated at 105 mm/sec, and charge and erase are repeated by charging the surface of the respective photoconductor drums 12 by a scorotron charger and erasing the charge by an eraser. Then, a supply current from the scorotron charger to a discharge wire is set constant (−150 μA), grid voltage applied to a grid electrode is increased to 0 to 1400 V, and the following values are acquired by measurement and calculation. As for the amount of potential generated in the overcoat layer 125, in order to eliminate any effect of residual potential remaining in the overcoat layer 125, two potential probes (potential sensors) are arranged respectively in positions on the front side and the rear side of the scorotron charger, and the amount of potential is measured based on the difference between potential at the portion on the front side of the scorotron charger and potential at the portion on the rear side of the scorotron charger. Furthermore, as for the amount of charge per unit area provided to the photoconductor drum 12 by the scorotron charger, the value is obtained by dividing an inflowing current (μA) measured by an ammeter connected to the photoconductor drum 12 by a scorotron discharge width (mm) in an axial direction of the photoconductor drum 12 and a moving velocity of the photoconductor drum 12, and then by multiplying the resultant value by 1000.

Figure 6:
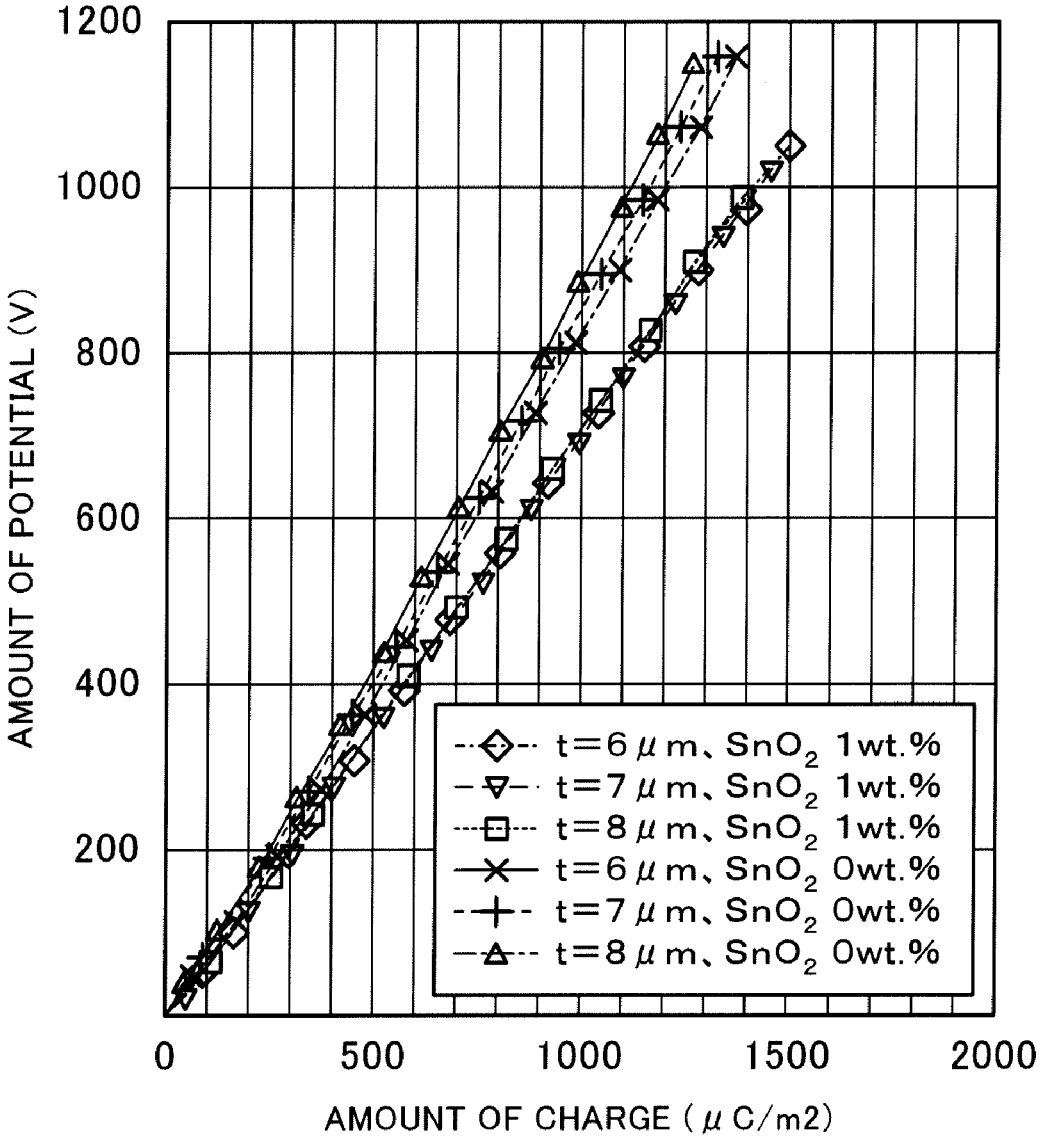
FIG. 6 is a graph showing evaluation results.

FIG. 6 is a graph showing evaluation results. Here, the horizontal axis represents an amount of charge per unit area provided to the photoconductor drum 12, and the vertical axis represents an amount of potential generated on the surface of the photoconductor drum 12. As shown in FIG. 6, it is observed that the relationship between the amount of charge (horizontal axis) and the amount of potential (vertical axis) hardly changes in the case where tin oxide, which is electroconductive particles, is added to the overcoat layer 125, even if the film thickness of the overcoat layer 125 is changed between 6 μm and 8 μm. On the other hand, it is observed that, in a conventional configuration example in which no electroconductive particles (tin oxide) are added, an amount of potential relative to an amount of charge ends up being changed when the film thickness of the overcoat layer 125 is changed between 6 μm and 8 μm, to be more specific, that an amount of potential is reduced as the film thickness of the overcoat layer 125 is reduced.

This indicates that, in the photoconductor drum 12 having the overcoat layer 125 containing electroconductive particles, the charge potential VH is kept constant, even if the surface of the photoconductor drum 12, that is, the overcoat layer 125, is worn out or locally worn out, as long as a constant amount of charge, that is, a constant inflowing current, is flowing into the photoconductor drum 12. Therefore, in the present exemplary embodiment, in the above-described operation of detecting the toner density and operation of determining an amount of toner to be supplied, it is configured to form a patch for toner density detection on the background region charged to have constant charge potential VH by adjusting a supply current supplied from the charging power supply 134 to the discharge wire 132 so that an inflowing current flowing into the photoconductor drum 12 is to be a predetermined constant set value.

Figure 7:
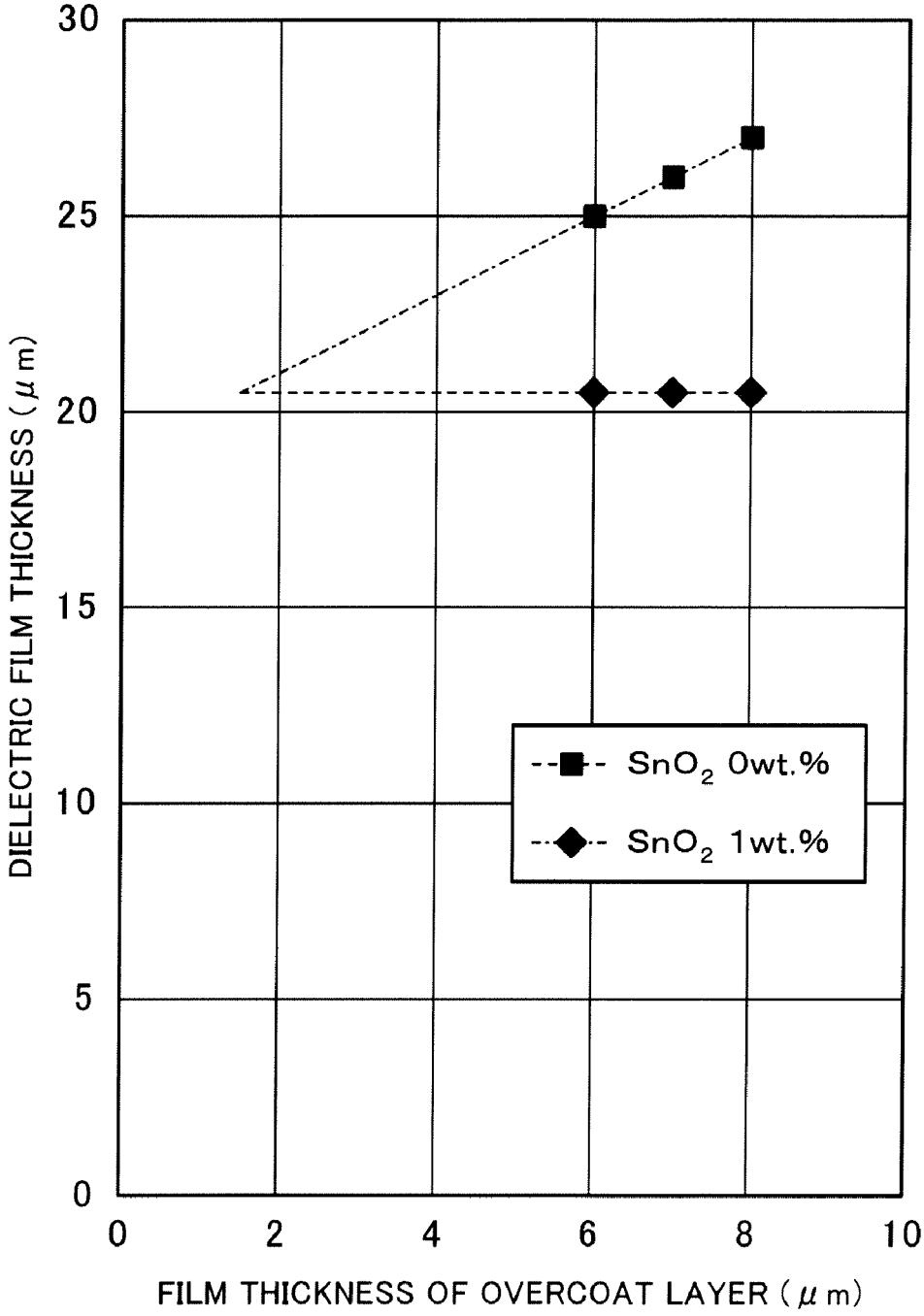
FIG. 7 is a graph showing the relationship between the film thickness of the overcoat layer and the dielectric film thickness of the photoconductive layer and the overcoat layer.

Here, FIG. 7 is a graph showing the relationship between the film thickness of the overcoat layer 125 and the dielectric film thickness of the photoconductive layer 126 and the overcoat layer 125 in each of the above-described samples. Here, the case where tin oxide having 1% by weight of the overcoat layer 125 is added to the overcoat layer 125 and the case where no tin oxide is added thereto are compared. It should be noted that, the dielectric film thickness represents a value obtained by dividing the entire film thickness of the photoconductive layer 126 and the overcoat layer 125 by the entire permittivity of the photoconductive layer 126 and the overcoat layer 125, and the value is measured by using Impedance Analyzer 4194A manufactured by Hewlett-Packard Development Company L.P., for example.

According to FIG. 7, it is observed that, in the case where tin oxide is added to the overcoat layer 125, the dielectric film thickness is constant regardless of the film thickness of the overcoat layer 125. On the other hand, in the case where no tin oxide is added to the overcoat layer 125, it is observed that the dielectric film thickness is increased as the film thickness of the overcoat layer 125 is increased, in other words, the dielectric film thickness is decreased as the film thickness of the overcoat layer 125 is reduced (wears out). This indicates that, in the case no electroconductive particles are added to the overcoat layer 125, its charge potential VH is lowered as the film thickness of the overcoat layer 125 is reduced. According to this result, it is understood that the charge potential VH is stabilized regardless of the change in the film thickness of the overcoat layer 125 by adding electroconductive particles to the overcoat layer 125.

This indicates that, in the photoconductor drum 12 having the overcoat layer 125 containing electroconductive particles, the electrostatic capacity hardly changes, even if the surface of the photoconductor drum 12, that is, the overcoat layer 125, is worn out or locally worn out, as long as the overcoat layer 125 exists, and the charge potential VH is maintained constant as a result.

Next, a description will be given of the relationship between a resin forming the overcoat layer 125 and electroconductive particles.

The inventors prepare a phenol resin, a melamine resin, and a benzoguanamine resin as resin materials, and tin oxide, zinc oxide, and titanium oxide as electroconductive particles. Then, the overcoat layers 125 are formed by adding each of kinds of the electroconductive particles to the respective resins. Here, the method of forming the overcoat layers 125 is the same as that in the above-described configuration example. Then, a cross section of each of the formed overcoat layers 125 is observed by the scanning electron microscope (SEM), and the degree of dispersion of electroconductive particles to the resin is visually evaluated. Here, the amount of electroconductive particles added to the respective overcoat layers 125 is 196 by weight of the overcoat layer 125.

FIG. 8 is a table showing the evaluation results. Here, grade A represents very good dispersivity, grade B represents good dispersivity, grade C represents poor dispersivity, and grade D represents very poor dispersivity. According to FIG. 8, it is observed that very good dispersivity is obtained in the case of a combination of a benzoguanamine resin and tin oxide, and good dispersivity is obtained in the case of a combination of a melamine resin and tin oxide. Good dispersivity indicates that electroconductive particles exist uniformly in the overcoat layer 125. For this reason, in the present exemplary embodiment, a benzoguanamine resin is used as a resin having a cross-linked structure forming the overcoat layer 125, and tin oxide is used as electroconductive particles. It should be noted that, in combinations rated with grade B to grade D as shown in FIG. 8, fluctuations in the charge potential VH due to wear on the surface of the photoconductor drum 12 are reduced as well, in the case where the photoconductor drum 12 is formed by using the overcoat layer 125 including a resin containing electroconductive particles.

In the present exemplary embodiment, a supply current supplied to the photoconductor drum 12 from the discharge wire 132 of the charging device 13 is controlled in accordance with an outflowing current flowing via the charge case 131 and the grid electrode 133; however, the present invention is not limited to this. To be more specific, an in flowing current to the photoconductor drum 12 is directly measured, and a supply current from the charging power supply 134 may be adjusted on the basis of the measurement result.

Furthermore, a non-contact scorotron charger is used as the charging device 13 in the present exemplary embodiment; however, a contact charging member, such as a charging roll, arranged to be in contact with the photoconductor drum 12 may be used, for example. In such a case, it is easier to directly measure a current flowing into the photoconductor drum 12 from the contact charging member.

Moreover, in the present exemplary embodiment, the density of a toner image formed on the photoconductor drum 12 is configured to be detected by the density sensor 15; however, the present invention is not limited to this. For example, it may be configured that a toner image formed on the photoconductor drum 12 is transferred onto the intermediate transfer belt 21 by the primary transfer device 16, and then the density of the toner image transferred onto the intermediate transfer belt 21 is detected by another density sensor.

Furthermore, in the present exemplary embodiment, the example of using the development device 14 adopting a reversal development method has been described; however, the present invention is not limited to this, and may be applied to an image forming apparatus using a development device adopting a charged area development method.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

a photoconductor that includes a photoconductive layer, and an overcoat layer containing electroconductive particles and provided on the photoconductive layer;

a charging unit that charges the photoconductor to first potential;

an exposure unit that sets an exposure region of the photoconductor to have second potential by exposing the photoconductor charged to the first potential by the charging unit, the second potential being smaller than the first potential in absolute values;

a development unit that includes a developer carrier carrying a two-component developer containing toner and carriers and a developing power supply setting the developer carrier to have third potential different from the first potential and the second potential;

a potential setting unit that sets the third potential smaller than the first potential and larger than the second potential in absolute values in a first image forming operation in which the photoconductor charged by the charging unit is exposed by the exposure unit and then developed by the development unit, and that sets the third potential larger than the first potential in absolute values in a second image forming operation in which the photoconductor charged by the charging unit is developed by the development unit without being exposed by the exposure unit;

a current setting unit that sets an inflowing current caused to flow into the photoconductor from the charging unit, to a fixed current value set in advance, in the second image forming operation;

a detection unit that detects image density of a toner image developed on the photoconductor in the second image forming operation; and a controller that controls toner supply with respect to the development unit in accordance with the image density detected by the detection unit, wherein the overcoat layer further contains a resin causing the electroconductive particles to disperse, the resin has a cross-linked structure and includes a benzoguanamine resin, the electroconductive particles are made of tin oxide, and an amount of the electroconductive particles added to the resin is selected within a range from about 0.1% by weight of the overcoat layer to about 5.0% by weight of the overcoat layer.

2. The image forming apparatus according to claim 1, wherein a volume average particle diameter d50 of the electroconductive particles of the overcoat layer is 0.3 μm or less.

3. The image forming apparatus according to claim 1, wherein the charging unit includes:

a charge case that has an opening portion at a position where the charge case is opposed to the photoconductor;

a discharge wire that is disposed inside the charge case;

a grid electrode in which a large number of air hole portions is formed and that is arranged on the opening portion side of the charge case so as to be opposed to the photoconductor;

a charging power supply that supplies a constant supply current to the discharge wire; and an ammeter that measures an outflowing current from the discharge wire via the charge case and the grid electrode, and the controller determines the supply current on the basis of the outflowing current measured by the ammeter.

4. A method of controlling toner supply, comprising:

charging, to charge potential set in advance, a photoconductor including a photoconductive layer and an overcoat layer containing electroconductive particles and provided on the photoconductive layer, by causing an inflowing current having a fixed current value set in advance to flow into the photoconductor;

transferring toner onto a charged region of the photoconductor from a developer carrier carrying a two-component developer containing toner and carriers, and developing a toner image, by setting the developer carrier to have developing potential larger than the charge potential in absolute values;

detecting image density of the toner image developed on the photoconductor; and controlling toner supply with respect to a development device including the developer carrier in accordance with the image density, wherein the overcoat layer further contains a resin causing the electroconductive particles to disperse, the resin has a cross-linked structure and includes a benzoguanamine resin, the electroconductive particles are made of tin oxide, and an amount of the electroconductive particles added to the resin is selected within a range from about 0.1% by weight of the overcoat layer to about 5.0% by weight of the overcoat layer.

* * * * *